US008776645B2

(12) United States Patent
Fried

(10) Patent No.: US 8,776,645 B2
(45) Date of Patent: Jul. 15, 2014

(54) KNOT LOOSENING DEVICE

(76) Inventor: Brian A. Fried, Melville, NY (US)

( * ) Notice: Subject to any disclaimer, the term of this patent is extended or adjusted under 35 U.S.C. 154(b) by 0 days.

(21) Appl. No.: 13/362,177

(22) Filed: Jan. 31, 2012

(65) Prior Publication Data

US 2012/0198971 A1 Aug. 9, 2012

Related U.S. Application Data

(60) Provisional application No. 61/441,088, filed on Feb. 9, 2011.

(51) Int. Cl.

| | |
|---|---|
| ***B25B 7/12*** | (2006.01) |
| ***B25B 11/00*** | (2006.01) |
| ***B25B 25/00*** | (2006.01) |

(52) U.S. Cl.
USPC ..... 81/302; 81/485

(58) Field of Classification Search
USPC ..... 81/302, 485
See application file for complete search history.

(56) References Cited

U.S. PATENT DOCUMENTS

| | | | | |
|---|---|---|---|---|
| 2,647,278 | A | 8/1953 | Weinberger | |
| 3,654,755 | A | 4/1972 | Bell | |
| 4,539,873 | A | 9/1985 | Freed | |
| 5,237,715 | A | 8/1993 | Bane, III | |
| 6,609,303 | B2 | 8/2003 | Rogel | |
| 7,055,413 | B1 | 6/2006 | Wang | |
| 7,398,956 | B2 * | 7/2008 | Clark et al. | 254/248 |
| 2012/0318109 | A1 * | 12/2012 | Parkin | 81/485 |

* cited by examiner

*Primary Examiner* — Monica Carter
*Assistant Examiner* — Danny Hong

(57) ABSTRACT

A knot loosening device and method of use. A pointed member is disposed, for inserting into the knot, followed by a midsection with a pry arm. Once the midsection is engaged, the pry arm is actuated by means of a lever arm which can be viewed as outwardly expanding jaws or jaw surfaces which have the effect of spreading or loosening the knot.

11 Claims, 3 Drawing Sheets

KNOT LOOSENING DEVICE

CROSS REFERENCE TO RELATED APPLICATIONS

This application claims priority from U.S. provisional application No. 61/441,088 filed 9 Feb. 2011; entitled "Knot Loosening Device". The entire contents being hereby incorporated by reference and for which benefit of the priority date is claimed.

FIELD OF THE INVENTION

The present invention relates to a tool having jaws, more particularly to a knot loosening device having outwardly expanding jaws or jaw surfaces which move apart when activated.

BACKGROUND OF THE INVENTION

Knots have been used for centuries in flexible or pliable elongated members such as ropes, cords, twine, laces and the like for fastening or holding fast the elongated members either to another elongated member or another structure.

People learn many different knots over time. The act of tying ones shoes, for example, involves a number of different knotting elements specifically an overhand knot with locking tuck on a bight (or two bites as necessary). All that is needed is for one loose end of the lace to double back through one of the bites and the knot becomes tangled when one tries to untie it.

Anyone who has had the experience of working with knots has also suffered the frustration of trying to untie a knot that has become tangled. A tangled knot can be defined as; "to seize and to hold in as if in a snare, or to unite or to knit together in intricate confusion". And anyone who has experienced a tangled knot can testify that, all too often, the harder one pulls on the ends of the elongated member, the tighter the knot becomes.

At that point, one must simply focus on elements of the knot itself to loosen the entanglements, often referred to as picking the knot. The problem here is that the knot, by that time, resembles a monolithic mess that no finger or picking device can successfully access from outside the knot.

SUMMARY OF THE INVENTION

In accordance with the present invention, there is provided a knot loosening device which inserts into the interior of the knot by means of a tapered spindle or mandrel which can be viewed as a conical awl. An awl can be defined as a pointed tool for piercing small holes, and is typically in the form of a spike or an elongated conical section. A pry member is found interior to the distal end of the awl which generally follows the same form for smoothness and ease of insertion. The pry member is designed to expand when a force is applied to a lever arm which then raised a pry arm to form an expansion and further loosen the knot from the inside.

The knot loosening device is formed such that an enlarged base is provided to fit into the hand of the user and having a fairly broad base to allow the user to push the device with a portion of the palm commonly referred to as the heel of the hand. This particular embodiment comprises a bulbous base, but those skilled in the art will be able to devise various embodiments which may include grips or pistol type grips for accomplishing the objects pointed out herein. It is further anticipated that those skilled in the art will recognize that the principles as explained and claimed herein can be scaled to larger or smaller devices depending upon application.

The leading end, or first end, of the device is in the form of a piercing member, being just sharp enough to fit between folds of the knot, but not too sharp so as to pierce the plies or cords which comprise the elongated member. The first end is generally in the form of a tapered spindle, mandrel, awl, or the like. The first end is inserted a predetermined portion of the knot, which is generally a fold or bite. The piercing member seamlessly giving way to a mid portion which comprises both a connecting arm and a pry arm. It is preferred that the combination of connecting arm and pry arm follow the taper of the first end. The device is inserted into the knot until the pry arm is engaged. The pry arm is operationally connected with a lever arm. The lever arm is actuated until the pry arm separates from the connecting arm, causing the knot to loosen.

It is therefore an object of the invention to provide a knot loosening device which provides access into the interior of the knot.

It is therefore an object of the invention to provide a pry arm for further separating the tangled elements from substantially inside the knot.

It is another object of the invention to provide a device having a broad, bulbous base member which can fit comfortably into the human hand and use the heel of the hand to drive the device into the knot.

It is another object in one aspect of the invention to provide a ring member attached to the device to further register and stabilize the hand.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION

Figure 1:
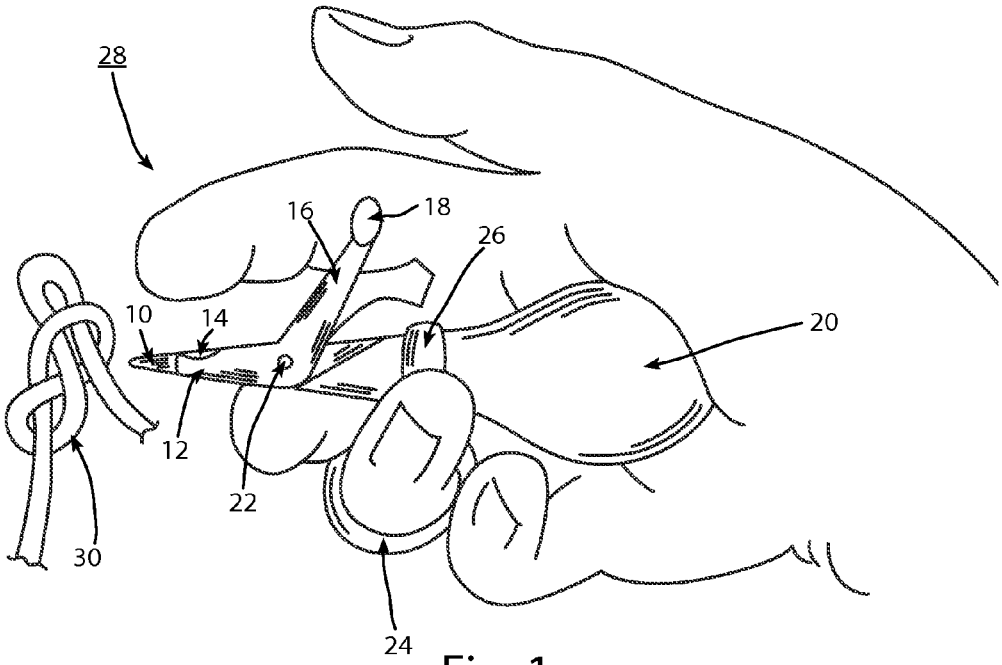
FIG. 1 is a perspective view of one embodiment of the invention being held for insertion.
Figure 2:
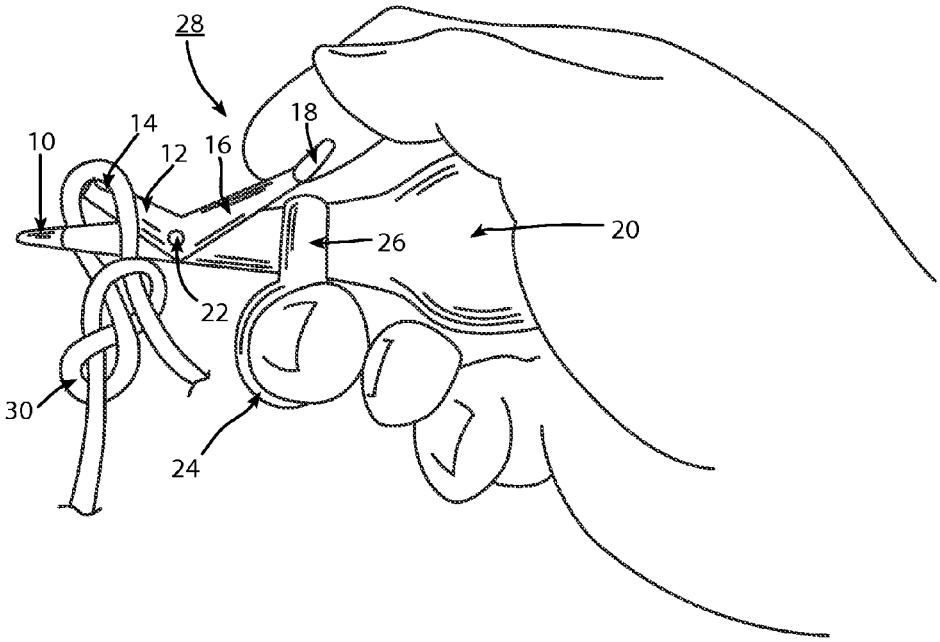
FIG. 2 is a perspective view of the embodiment of FIG. 1 having the lever arm engaged causing the pry arm to be expanded resulting in the knot being loosened.
Figure 3:
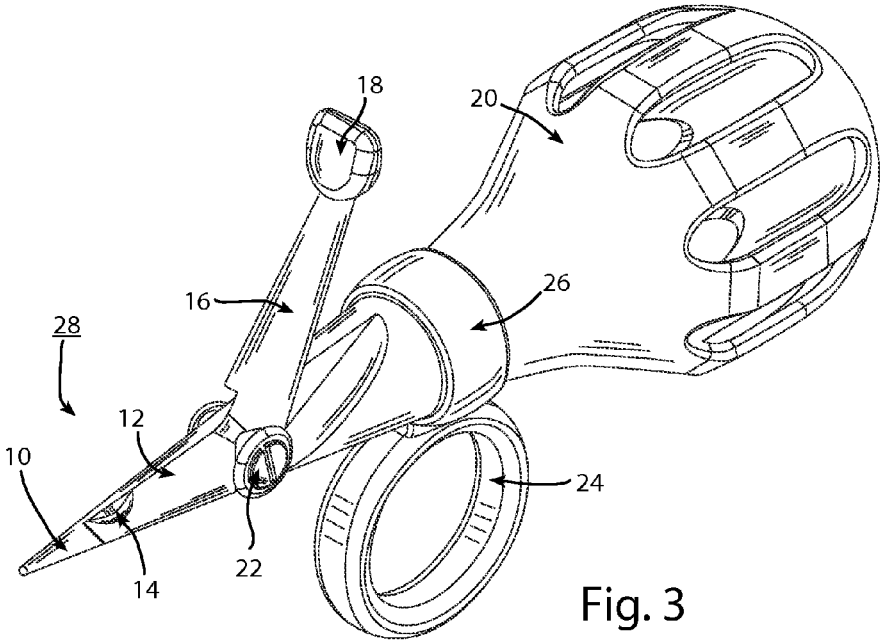
FIG. 3 is perspective view of one embodiment of the invention.

As depicted in FIGS. 1-3, a knot (30), which is shown a little loose in order to better illustrate the various folds and contours, is provided in FIG. 1 to represent a knot that may be found by the user in a flexible elongated member. The knot loosening device (2) is provided comprising a distal or first end (10) being generally in the form of an awl or mandrel which can be inserted and pressed into the knot until the pry arm (12) is engaged. A connection arm (11), located between the first and second ends works in opposition to the pry arm (12) to form the two outwardly expanding jaws. Leverage to push the device (2) to insert the first end (10) for engaging the knot can be applied by pushing the base (20) as shown preferably by the heel portion of the palm of the hand. The pry arm (12), which can optionally comprise a catch (14) in order to better register and hold a portion of the elongated member, is rigidly connected or formed with a lever arm (16) and can further comprise a trigger member (18), which is provided to the user for registration by feel, to form the pry member (28) assembly. The pry member assembly (28) is mounted in the mid portion of the device by means of a trunnion (22) which is also referred to as a pivot pin about which the pry member assembly (28) pivots or rotates. As the pry arm (12) is engaged, the user provides a force, as can be seen in FIG. 2, to the lever arm (16) causing the pry arm (12) to separate from the mid portion of the device (2).

When the knot (30) is loosened to the point that the user can 'pick it out' by means of the fingers, or other conventional methods, the pry member assembly (28) can be returned to the original position as shown in FIG. 1 and the device retracted from the loosened knot.

A stabilization member (24) which can take a variety of embodiments, but is preferably in the form of a ring, can be supplied and attached by means of a holding member (26) to provide further registration and stabilization for the user. Although shown in FIGS. 1 and 2 with the ring finger engaged with the stabilization member (24) and the pointer or index finger actuating the trigger (18). By way of illustration, those skilled in the art would recognize that the device (2) can also be utilized where the index or pointer finger can be engaged with the stabilization member (24) and the thumb can actuate the trigger (18).

Figure 4A:
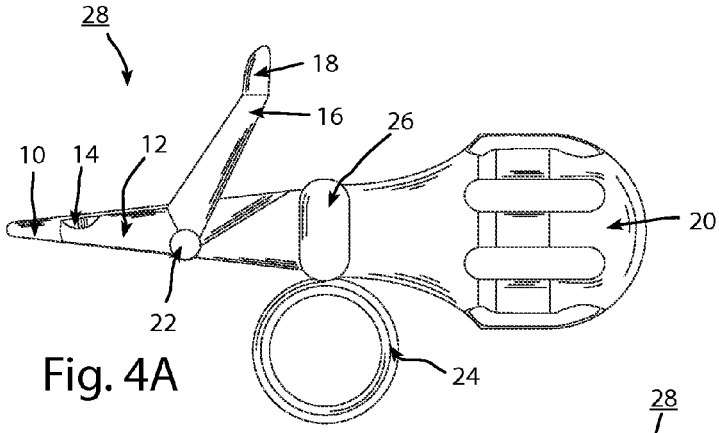
FIG. 4A is a side orthogonal view of the embodiment of FIG. 3.
Figure 4B:
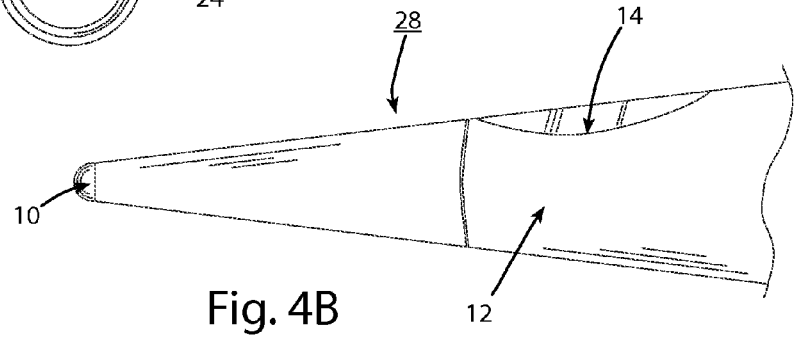
FIG. 4B is a detail view side level view of the distal end shown in FIG. 4A.
Figure 5:
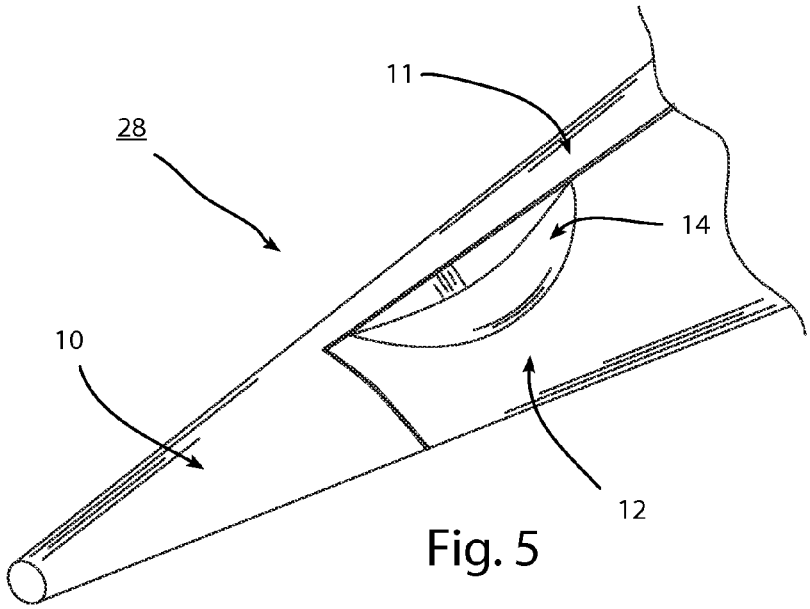
FIG. 5 is a perspective view similar to FIG. 4B.
Figure 6A:
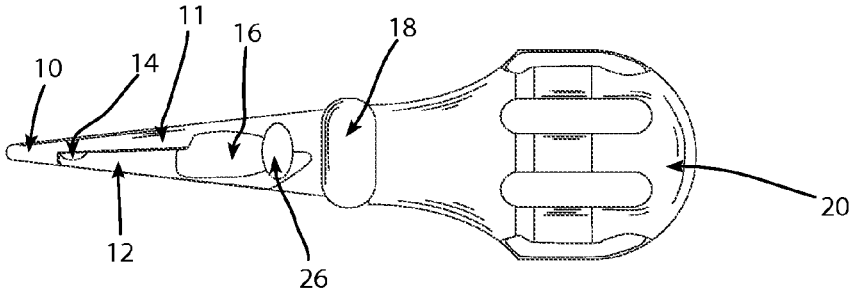
FIG. 6A is a top orthogonal view of an embodiment of the invention.
Figure 6B:
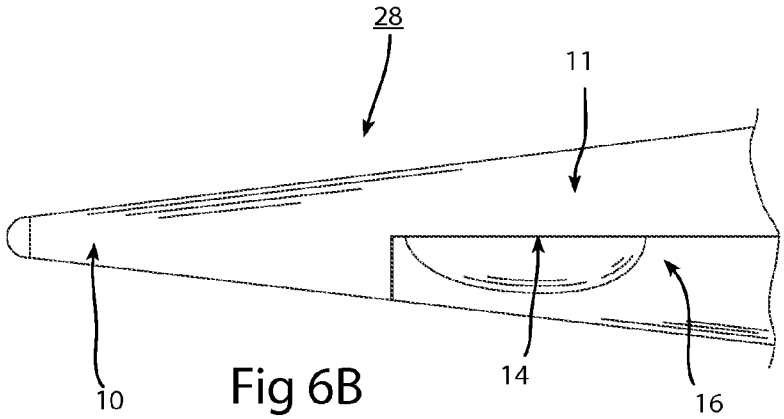
FIG. 6B is a detail view of the distal end shown in FIG. 6A.

FIGS. 4 through 6 are further provided to show various attributes and features of one preferred embodiment of the present invention. The first end (10) may be radiused or blunted and sized in order to slip nicely between folds of the cord and not simply pierce it. It is preferred that the transition between the first end (10) and the middle portion which comprises the pry arm (12) and the connecting arm (11) be smooth and follow the same taper for ease of use. Optionally a catch (14) being a depression, recess, or the like, can be formed to contour or conform with the diameter and type of cord being used in order to better grip or pull the folds of the knot to facilitate loosening.

One skilled in the art will recognize that the base (20) shown here as bulbous in shape can be a formed in a wide variety of shapes. Some preferences of design being to transfer the pressure from pushing with the heel of the hand to the first end (10) and provide an ergonomic grip or holding member.

A ratcheting mechanism (not shown) can also be incorporated with the pry member, comprising the pry arm (12) and the lever arm (16) in order to further leverage the operation of the device (2).

CONCLUSION, RAMIFICATIONS, AND SCOPE

Although the present invention has been described in detail, those skilled in the art will understand that various changes, substitutions, and alterations herein may be made without departing from the spirit and scope of the invention in its broadest form. The invention is not considered limited to the example chosen for purposes of disclosure, and covers all changes and modifications which do not constitute departures from the true spirit and scope of this invention.

Having thus described the invention, what is desired to be protected by Letters Patent is presented in the subsequent appended claims.

I claim:

1. An method for loosening a knot in a pliant elongated member using a knot loosening device comprising:

(i) providing a device having a first end, a second end, and a midportion; the first end being a piercing member giving way to a taper, the second end being a base member;

(ii) providing a pry member assembly comprising a pry arm being operationally connected with a lever arm;

(iii) the middle portion comprising a recess such that the combination of the pry arm and the middle portion substantially continues the shape of the taper of the first end, the pry member being pivotally mounted to the middle portion;

(iv) inserting the first end of the device into a predetermined portion of a knot by means of applying pressure to the second end until the pry arm becomes engaged with the knot, (v) applying a force to the lever arm sufficient to cause the pry arm to pivot away from the middle portion;

(vi) whereby the knot is loosened.

2. A method for loosening a knot in accordance with claim 1 wherein the lever arm is actuated by one of the forefinger or thumb.

3. A method for loosening a knot in accordance with claim 2 wherein the pry arm and the lever arm form an obtuse angle with one another, the pry member assembly being rotationally attached to the middle portion by means of a trunnion.

4. A method for loosening a knot in accordance with claim 3 the pry member further comprising a catch.

5. A method for loosening a knot in accordance with claim 4 wherein the catch topology is substantially matched with the sectional dimension of the pliant elongated member.

6. A method for loosening a knot in accordance with claim 4 wherein the piercing member is substantially in the shape of a mandrel.

7. A method for loosening a knot in accordance with claim 6 wherein the middle portion further comprises a stabilization member.

8. A method for loosening a knot in accordance with claim 7 wherein the stabilization member comprises a ring for receiving a finger.

9. An method for loosening a knot in a pliant elongated member using a knot loosening device comprising:

(i) providing a device having a first end, a second end, and a midportion; the first end being a piercing member in the form of a conical awl, the second end being a bulbous base member;

(ii) providing a pry member assembly comprising a pry arm having a catch being rigidly connected at an obtuse angle with a lever arm, and the pry member having a pilot hole suitable for receiving a trunnion member being situated substantially at the vertex of the obtuse angle, (iii) the middle portion comprising a recess such that the combination of the pry arm and the middle portion substantially continues the shape of the piercing member, the pry member being pivotally mounted on the trunnion member and the lever arm extending away from the middle portion; the middle portion further comprising a stabilization member as an aid for gripping;

(iv) inserting the first end of the device into a predetermined portion of a knot by means of applying pressure by means of the palm of the hand to the second end until the catch of the pry arm becomes engaged with the knot, (v) applying a force to the lever arm sufficient to cause the pry arm to pivot away from the middle portion;

(vi) whereby the knot is loosened.

10. An method for loosening a knot in a pliant elongated member using the knot loosening device in accordance with claim 9 wherein the lever arm is designed to be actuated by one of a forefinger or thumb.

11. An method for loosening a knot in a pliant elongated member using the knot loosening device in accordance with claim 10 the lever arm further comprising a trigger member.

* * * * *